US007800556B2

(12) United States Patent
Chen et al.

(10) Patent No.: US 7,800,556 B2
(45) Date of Patent: Sep. 21, 2010

(54) ORGANIC LIGHT EMITTING DIODE DISPLAY AND PIXEL DRIVING METHOD THEREOF

(75) Inventors: Yung-Chih Chen, Taichung County (TW); Kuo-Sheng Lee, Tainan County (TW); Ting-Wen Wu, Taipei (TW); Li-Wei Shih, Chiayi County (TW); Chih-Lung Lin, Tainan County (TW)

(73) Assignee: Au Optronics Corp., Hsin-Chu (TW)

( * ) Notice: Subject to any disclaimer, the term of this patent is extended or adjusted under 35 U.S.C. 154(b) by 807 days.

(21) Appl. No.: 11/683,498

(22) Filed: Mar. 8, 2007

(65) Prior Publication Data

US 2007/0210994 A1 Sep. 13, 2007

(30) Foreign Application Priority Data

Mar. 10, 2006 (TW) ..... 95108241 A

(51) Int. Cl.
*G09G 3/30* (2006.01)

(52) U.S. Cl. ..... 345/76; 345/82; 345/83; 315/169.3; 362/227; 313/506; 313/313

(58) Field of Classification Search ..... 345/76, 345/82, 83
See application file for complete search history.

(56) References Cited

U.S. PATENT DOCUMENTS

| | | | | |
|---|---|---|---|---|
| 6,859,193 | B1 | 2/2005 | Yumoto | |
| 2002/0050962 | A1 * | 5/2002 | Kasai | 345/76 |
| 2003/0020413 | A1 * | 1/2003 | Oomura | 315/169.3 |
| 2004/0056604 | A1 * | 3/2004 | Shih et al. | 315/169.2 |
| 2004/0217925 | A1 * | 11/2004 | Chung et al. | 345/76 |
| 2005/0219169 | A1 * | 10/2005 | Chung et al. | 345/76 |
| 2006/0145965 | A1 * | 7/2006 | Choi et al. | 345/76 |
| 2006/0187153 | A1 * | 8/2006 | Nathan et al. | 345/76 |
| 2006/0232521 | A1 * | 10/2006 | Jang et al. | 345/76 |

FOREIGN PATENT DOCUMENTS

TW I237913 10/2004

OTHER PUBLICATIONS

"Optical Feedback for AMOLED Display Compensation using LTPS and a-Si:H Technologies" Fish et al., 2005, pp. 1340-1343.
"A New Voltage-Modulated AMOLED Pixel Design Compensating for Threshold Voltage Variation in Poly-Si TFTs" Jung et al., 2004, pp. 690-692.
"A New a-Si:H TFT Pixel Circuit Compensating the Threshold Voltage Shift of a-Si:H TFT and OLED for Active Matrix OLED" Lee et al., 2005, pp. 897-899.

* cited by examiner

*Primary Examiner*—Amare Mengistu
*Assistant Examiner*—Premal Patel
(74) *Attorney, Agent, or Firm*—Thomas, Kayden, Horstemeyer & Risley

(57) ABSTRACT

A light emitting diode (OLED) display and pixel driving method thereof are disclosed. Each storage capacitor is discharged via the driving TFT and OLED until conductive current of each OLED is almost zero so as to record a sum of a voltage drop across each OLED under a specific condition and the threshold voltage of the driving TFT. By using the sum of the voltage drop across each OLED and the threshold voltage of the corresponding TFT in the subsequent OLED driving process, the luminance reduction issue caused by TFT threshold-voltage shift and OLED material decay can be solved.

9 Claims, 4 Drawing Sheets

ORGANIC LIGHT EMITTING DIODE DISPLAY AND PIXEL DRIVING METHOD THEREOF

This application claims the benefit of Taiwan Patent Application Serial No. 95108241, filed Mar. 10, 2006, the subject matter of which is incorporated herein by reference.

BACKGROUND OF THE INVENTION

1. Field of the Invention

The invention relates in general to an organic light emitting diode (OLED) display, and more particularly to a method for driving OLED pixels.

2. Description of the Related Art

In a pixel of an organic light emitting (OLED) display, charges are stored in a storage capacitor for controlling the luminance of an OLED via a thin film transistor (TFT). Referring to FIG. 1, a schematic diagram of a conventional pixel circuit is shown. The pixel circuit 100 includes an N-type TFT 102, a storage capacitor 104 and an OLED 106. The two ends of the storage capacitor 104 are respectively coupled to the gate G and the source S of the TFT 102. The voltage drop of the storage capacitor 104 is denoted by Vgs. The positive end of the OLED 106 is coupled to the source S of the TFT 102, whose voltage level is denoted by VOLED. The current flowing by the TFT 102 is controlled by the voltage drop Vgs, that is, the current IOLED of the OLED 106 is equal to $K*(Vgs-VTH)^2$. The voltage drop Vgs is a voltage difference between a pixel voltage Vdata and the voltage level $V_{OLED}$ at the positive end of the OLED 106. Therefore, the luminance of the OLED 106 can be controlled by adjusting the pixel voltage Vdata.

However, when the above-mentioned TFT 102 is operated, a shift of the threshold voltage occurs on the TFT 102. The voltage shift amount is related to a manufacturing process, operation time and current of the TFT 102. Therefore, in terms of all pixels on the display panel, due to difference of the pixels in the operation time, conductive current and manufacturing process, the shift amount of the threshold voltage of each pixel is different, which in turn causes the luminance and the received pixel voltage of each pixel to have different corresponding relationship. Therefore, the issue of non-uniform frame luminance occurs.

Besides, the OLED 106 has an increasing voltage drop, that is, an increasing VOLED, along with the using time. Referring to FIG. 2, a characteristic diagram of the OLED 106 is shown. From FIG. 2, it can be seen that the OLED 106 has an increasing VOLED under a long using time. Therefore, the conductive current IOLED is reduced under the long using time according to the equation Vgs=Vdata−VOLED. The decreasing current IOLED causes that the pixel voltage Vdata cannot drive the OLED 106 to reach the predetermined luminance. That is, the overall luminance of a display frame is reduced.

In conclusion, even if the issue that the threshold voltage shift causes unequal driving currents to flow by the OLEDs can be solved, frame luminance is still reduced or becomes non-uniform due to material feature variation of the OLEDs. Therefore, how to simultaneously solve the issue of TFT threshold-voltage shift and OLED material decay is indeed an essential subject for the relevant industrials.

SUMMARY OF THE INVENTION

It is therefore an object of the invention to provide an OLED display and pixel driving method thereof. The issue of TFT threshold-voltage shift and OLED material decay can be solved simultaneously to improve quality of display frames.

The invention achieves the above-identified object by providing a method for driving a pixel. The pixel has an OLED, a storage capacitor and a TFT. The TFT has a first terminal, a second terminal and a gate. The first terminal is electrically coupled to one end of the OLED, and the other end of the OLED is for receiving a first voltage. The second terminal is for receiving a second voltage. The gate of the TFT is electrically coupled to an end of the storage capacitor, and the TFT is for driving the OLED to emit light. The method includes providing the second voltage to the end of the storage capacitor and providing a pixel voltage to the other end of the storage capacitor; discharging the end of the storage capacitor via the first terminal and the second terminal of the TFT and the OLED until conductive current of the OLED is almost zero, and the storage capacitor stores an amount of charges; and generating a pixel current for driving the OLED to emit light by the TFT according to the amount of charges of the storage capacitor.

The invention achieves the above-identified object by providing a OLED pixel circuit including a storage capacitor, an OLED, a first TFT, a second TFT, a third TFT, a fourth TFT and a fifth TFT. The OLED has a first end and a second end. The second end of the OLED is coupled to a first voltage. The first TFT is for driving the OLED to emit light, and the first TFT has a gate electrically coupled to one end of the storage capacitor and a first terminal electrically coupled to a first end of the OLED. The second TFT has a gate for receiving a first scan signal, a first terminal for receiving a second voltage and a second terminal for electrically coupling to a second terminal of the first TFT. The third TFT is for discharging the storage capacitor via the first TFT and the OLED. The third TFT has a gate for receiving a second scan signal, and a first terminal and a second terminal respectively coupled to the second terminal and the gate of the first TFT. The fourth TFT has a gate for receiving the second scan signal, a first terminal electrically coupled to the other end of the storage capacitor and a second terminal for receiving a pixel voltage. The fifth TFT has a gate for receiving the first scan signal, a first terminal electrically coupled to the first terminal of the first TFT, and a second terminal electrically coupled to the other end of the storage capacitor. The first voltage is smaller than the second voltage.

The invention achieves the above-identified object by providing an OLED display including a driving circuit, and at least a pixel circuit. The driving circuit is for outputting a pixel voltage, a first scan signal and a second scan signal. The pixel circuit includes an OLED, a storage capacitor, a first TFT, a second TFT, a third TFT, a fourth TFT and a fifth TFT. The OLED has a first end and a second end and the second end of the OLED is coupled to a first voltage. The first TFT is for driving the OLED to emit light. The first TFT has a gate electrically coupled to one end of the storage capacitor, and a first terminal electrically coupled to the first end of the OLED. The second TFT has a gate for receiving the first scan signal, a first terminal for receiving a second voltage and a second terminal electrically coupled to a second terminal of the first TFT. The third TFT is for discharging the storage capacitor via the first TFT and the OLED and has a gate for receiving the second scan signal, and a first terminal and a second terminal respectively coupled to the second terminal and the gate of the first TFT. The fourth TFT has a gate for receiving the second scan signal, a first terminal electrically coupled to the other end of the storage capacitor, and a second terminal for receiving a pixel voltage. The fifth TFT has a gate for receiving the first scan signal, a first terminal electrically coupled to the first terminal of the first TFT, and a second terminal electrically coupled to the other end of the storage capacitor.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
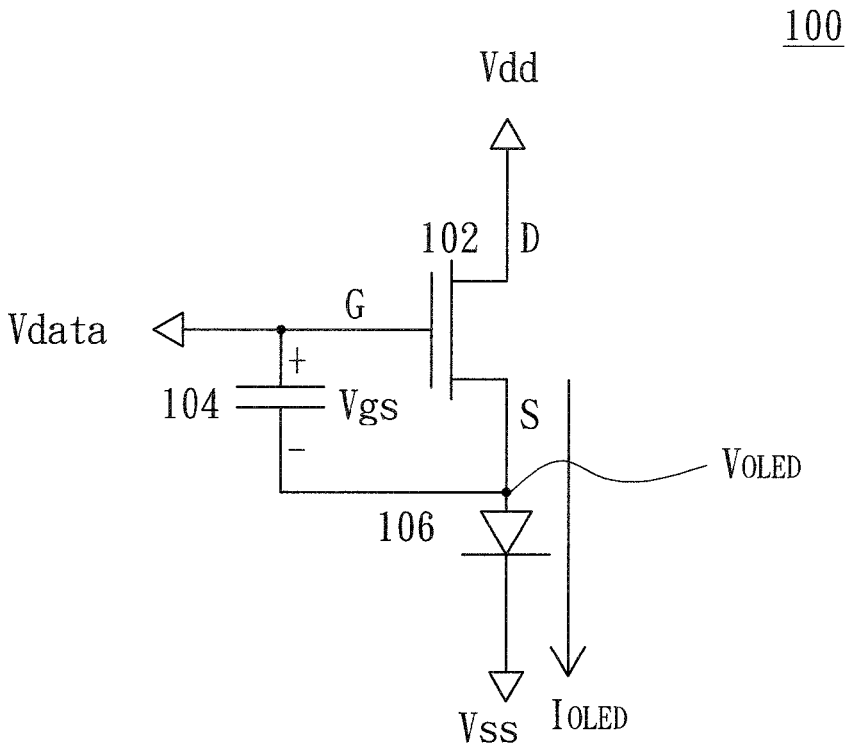
FIG. 1(RELATED ART)
FIG. 1 is a schematic diagram of a conventional pixel circuit.
Figure 2:
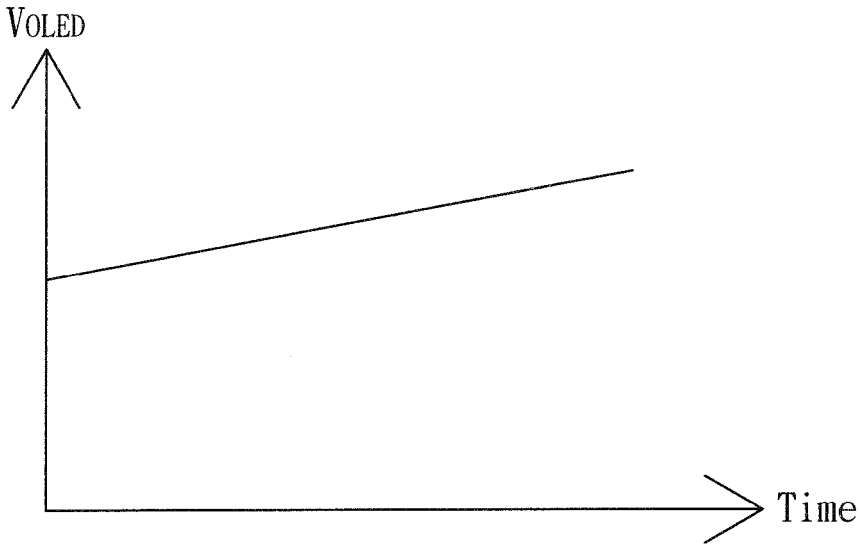
FIG. 2(RELATED ART)
FIG. 2 is a characteristic diagram of the OLED in FIG. 1.
Figure 3:
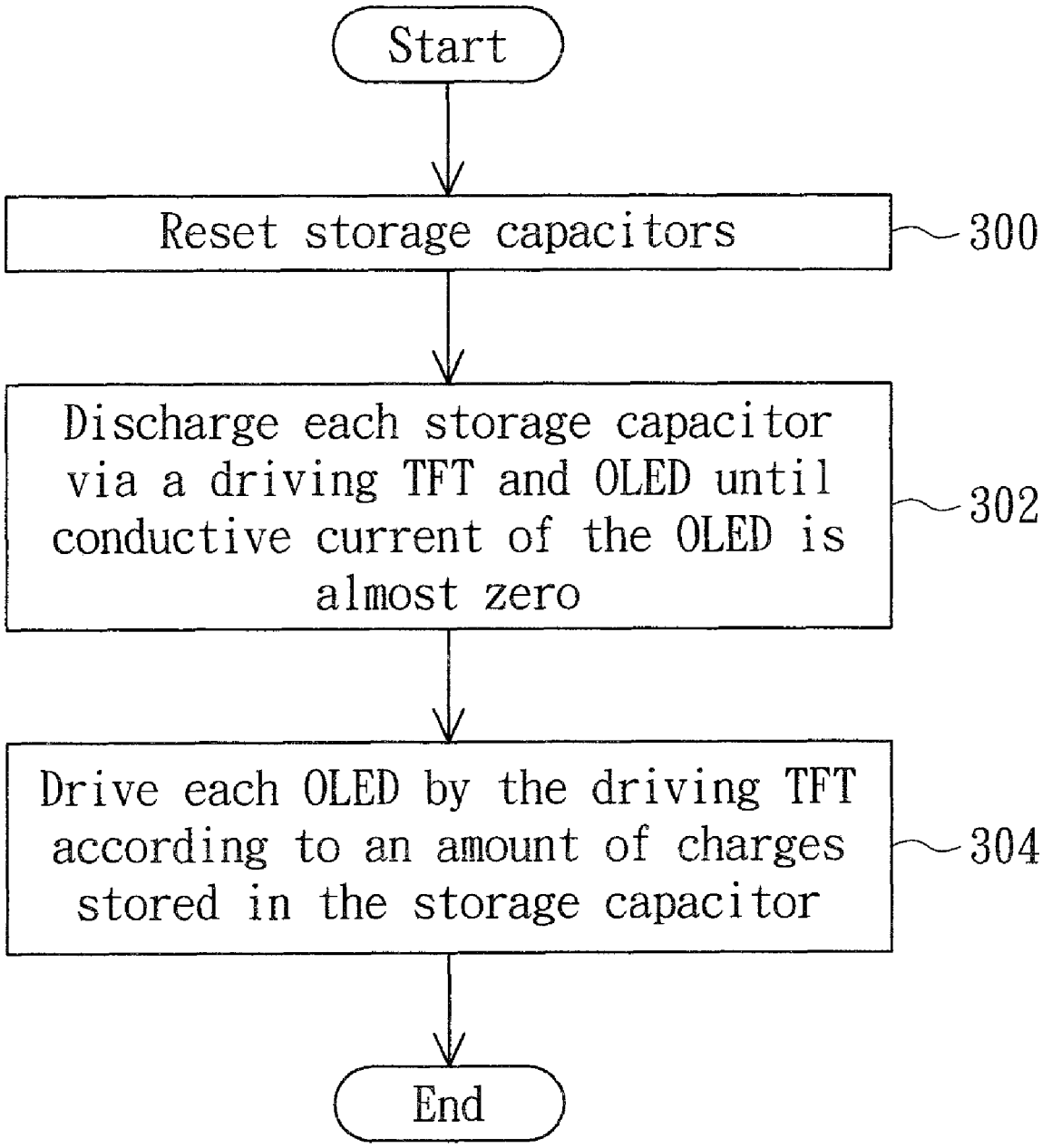
FIG. 3 is a flow chart of the method for driving OLED pixels according to the invention.

The invention provides a method for driving OLED pixels, which can simultaneously solve the issue of TFT threshold-voltage shift and OLED material decay. Referring to FIG. 3, a flow chart of the method for driving OLED pixels according to the invention is shown. First, in step 300, reset storage capacitors. Next, in step 302, discharge each storage capacitor via a driving TFT and OLED until conductive current of the OLED is almost zero and record a sum of the threshold conductive voltage of the driving TFT and the voltage drop across the OLED under a specific condition. In a subsequent OLED driving process, the reduction of frame luminance due to TFT threshold-voltage shift and OLED material decay can be avoided by using the sum of the threshold conductive voltage and OLED voltage drop.

Afterward, in step 304, drive each OLED by the corresponding driving TFT according to an amount of charges stored in the corresponding storage capacitor.

Figure 4:
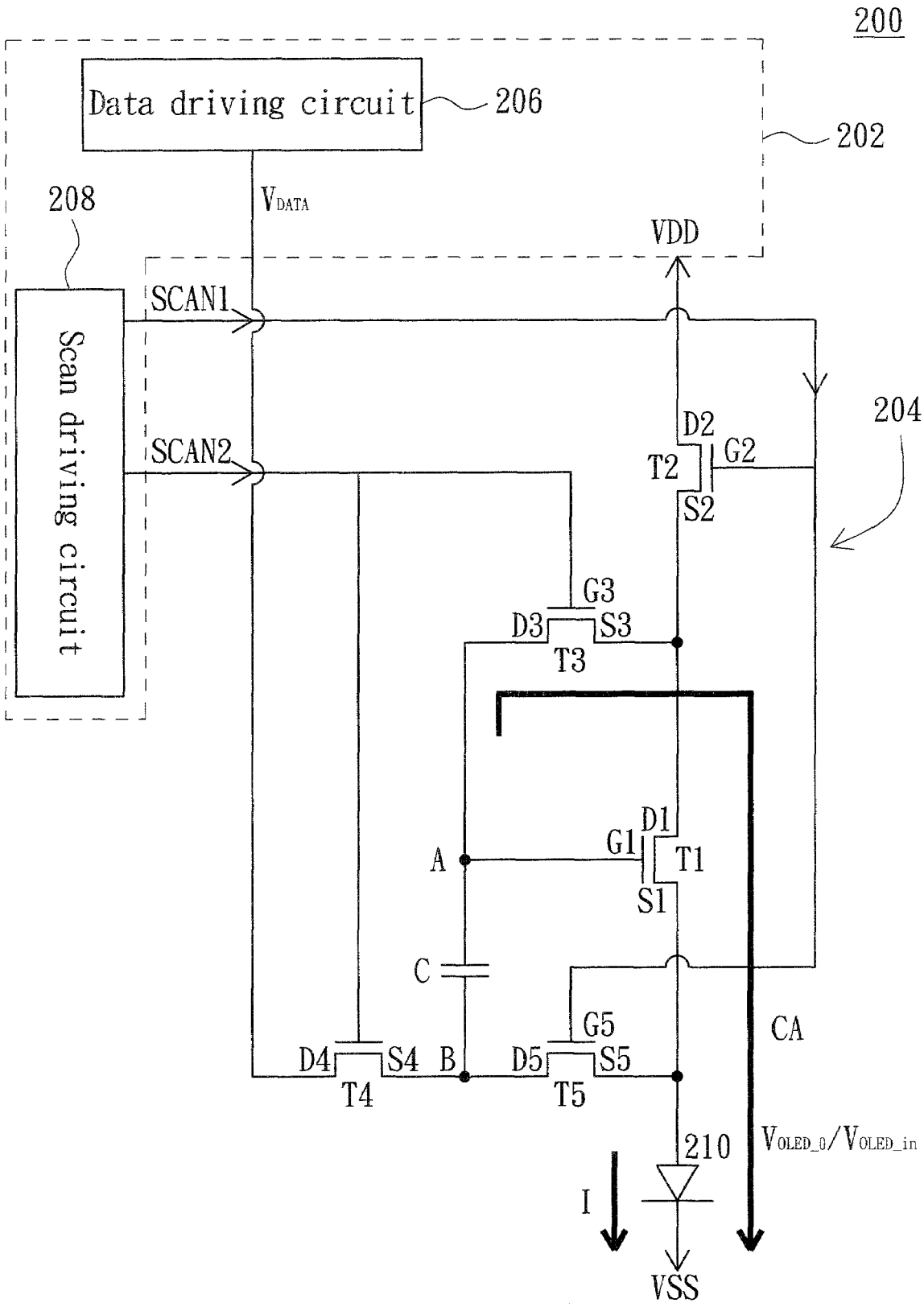
FIG. 4 is a schematic diagram of an OLED display according to a preferred embodiment of the invention.

Referring to FIG. 4, a schematic diagram of an OLED display according to a preferred embodiment of the invention is shown. The OLED display 200 includes at least a driving circuit 202 and a number of pixel circuits. FIG. 4 shows a pixel circuit 204 as an example. The pixel circuit 204 includes an OLED 210, a storage capacitor C, a first TFT T1, and four switches. For example, the four switches are implemented by TFTs, that is, the first switch, the second switch, the third switch and the four switch are respectively a second TFT T2, a third TFT T3, a fourth TFT T4 and a fifth TFT T5. In the embodiment, five TFTs T1~T5 are N-type metal oxide semiconductor (NMOS) transistors, each having three terminals. However, any one who is skilled in the art will know that the TFTs of the invention can also be implemented by using P-type metal oxide semiconductor (PMOS) transistors or a part of TFTs are implemented by NMOS transistors and the other part of the TFTs are implemented by PMOS transistors.

The driving circuit 202 is for providing a first voltage VSS and a second voltage VDD and includes at least a data driving circuit 206 and a scan driving circuit 208. The data driving circuit 206 is for providing pixel voltages VDATA and the scan driving circuit 208 is for providing a first scan signal SCAN1 and a second scan signal SCAN2.

The OLED 210 has a first end and a second end. If the first TFT T1 is an NMOS transistor, the first terminal of the corresponding OLED 210 is a positive end and the second end of the corresponding OLED 210 is a negative end and coupled to the first voltage VSS. The first TFT T1 is for driving the OLED 210 to emit light. The first TFT T1 has a gate electrically coupled to one end A of the storage capacitor C, and a first terminal S1 (source) electrically coupled to the positive end of the OLED 210. The second TFT T2 has a gate for receiving the first scan signal SCAN1, a first terminal D2 for receiving the second voltage VDD, and a second terminal D2 electrically coupled to the second terminal D1 of the first TFT T1. The third TFT T3 is for discharging the storage capacitor C via the first TFT T1 and the OLED 210. The third TFT T3 has a gate for receiving the second scan signal SCAN2, and a first terminal D3 and a second terminal S3 respectively coupled to the second terminal D1 and the gate G1 of the first TFT T1.

The fourth TFT T4 had a gate G4 for receiving the second scan signal SCAN2, a first terminal S4 electrically coupled to the other end B of the storage capacitor C, and a second terminal D4 for receiving the pixel voltage VDATA. The fifth TFT T5 has a gate G5 for receiving the first scan signal SCAN1, a first terminal S5 electrically coupled to the first terminal S1 of the first TFT T1, and a second terminal D5 electrically coupled to the end B of the storage capacitor C.

Figure 5:
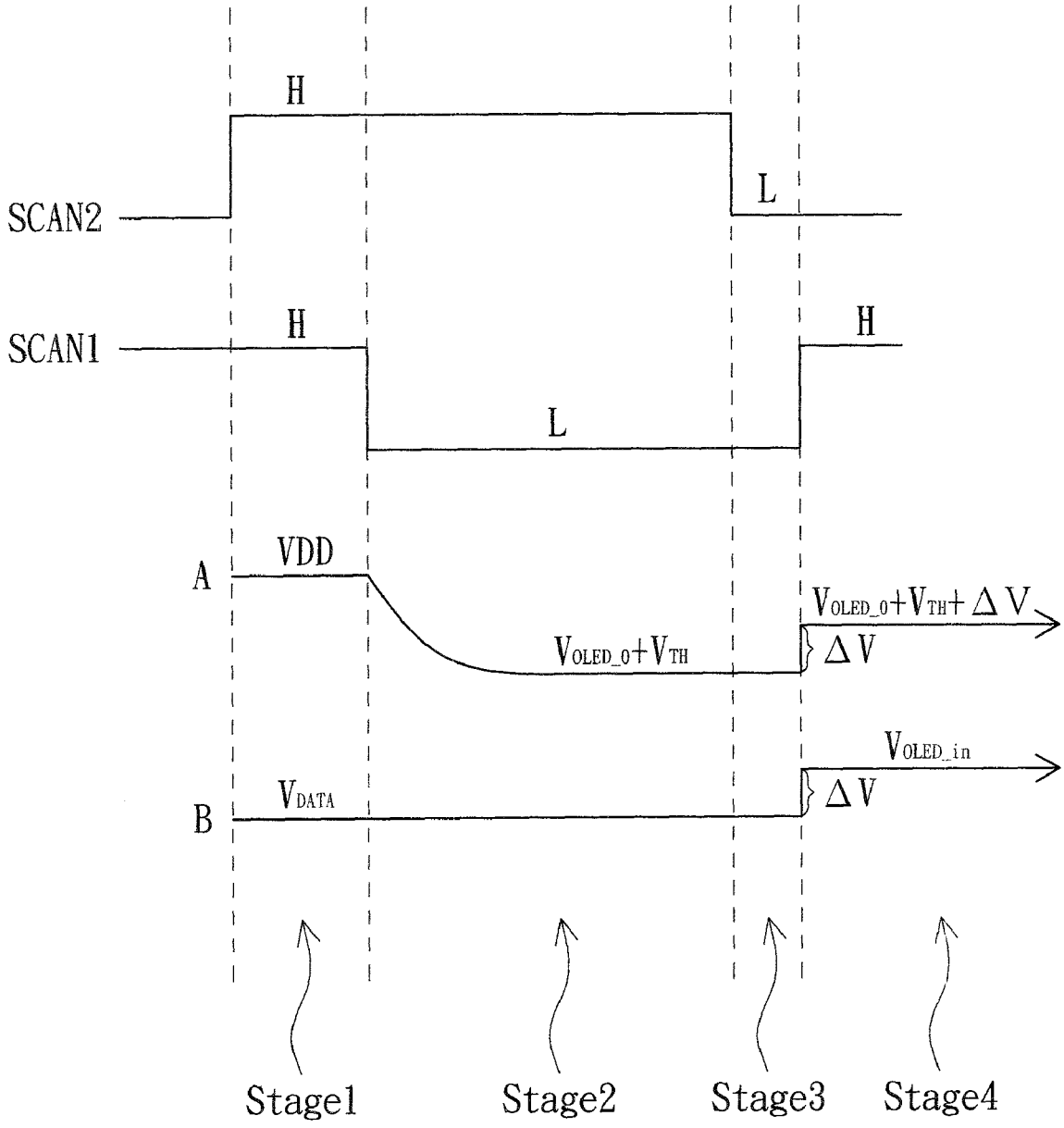
FIG. 5 is a timing diagram of the pixel driving method according to the invention.

Referring to FIG. 5, a timing diagram of the pixel driving method according to the invention is shown. In the pixel driving process, a reset procedure, that is, a first stage 'stage1' shown in FIG. 5, is added in order to reset the storage capacitor C. In the first stage 'stage1', the first scan signal SCAN1 and the second scan signal are changed to have a high voltage level H to switch on the TFTs T2~T5 and the data driving circuit 206 provides a pixel voltage VDATA. Therefore, the second voltage VDD is inputted to the end A of the storage capacitor C via the switched-on second TFT T2 and third TFT T3, that is, the voltage at the end A of the storage capacitor C is VDD. The pixel voltage VDATA is inputted to the end B of the storage capacitor C via the switched-on fourth TFT T4, that is, the voltage at the end B of the storage capacitor C is VDATA.

Following that, in the second stage 'stage2', the first scan signal SCAN1 is changed to have a low voltage level L to switch off the TFTs T2 and T5 while the second scan signal SCAN2 maintains to have the voltage level H as in the previous stage. The data driving circuit 206 continuously provides the pixel voltage VDATA. Therefore, the storage capacitor C is discharged via a discharge path CA formed by the switched-on third TFT T3, that is, the charges of the storage capacitor C corresponding to the first voltage VSS are released via the drain-source D1-S1 of the first TFT T1 and the OLED 210, until conductive current of the OLED 210 is almost zero. At the time, the positive end of the OLED 210 has a voltage level VOLED_0. The voltage level VOLED_0 is changed along with material decay of the OLED 210. That is, the longer the OLED 210 is operated, the higher the voltage level VOLED_0 is. The voltage at the end A of the storage capacitor C can be determined by a summation (VOLED_O+VTH) of the voltage level VOLED_0 and the threshold voltage VTH. The voltage at the end B of the storage capacitor C maintains at VDATA.

Afterward, in order to ensure that all pixels can have the same operation, for example, the storage capacitors C of all pixels are discharged to a stable state, the TFTs T2~T5 are closed for a short period of time as shown in the third stage 'stage3' Next, in the fourth stage 'stage4', the first scan signal SCAN1 is changed to the voltage level H to switch on the second TFT T2 and the fifth TFT T5 while the second scan signal SCAN2 maintains at the voltage level L as in the previous stage. Therefore, the first TFT T1 can drive the OLED 210 to emit light according to the amount of charges in the storage capacitor C. At the time, the voltage at the end B of the storage capacitor C is changed to the voltage level VOLED_in of the positive end of the switched-on OLED 210 due to the effect of the switched-on fifth TFT T5, and the voltage at the end A of the storage capacitor C is increased by ΔV due to continuousness of voltages of a capacitor at two ends. The voltage ΔV is equal to the difference between the voltage VOLED_in and the voltage VDATA at the end B, that is, ΔV=VOLED_in−VDATA. Therefore, the voltage at the end A of the storage capacitor will finally be changed to VOLED_0+VTH+ΔV=VOLED_0+VTH+VOLED_in−VDATA.

The driving current I of the first TFT T1 is K*(VG1S1−VTH)$^2$, the gate G1 voltage is the A-end voltage, and the source S1 voltage is the B-end voltage. Therefore, the driving current I can be derived by the equation:

$$I=K^*[(\text{VOLED_0}+\text{VTH}+\text{VOLED_in}-\text{VDATA}-\text{VOLED_in})-\text{VTH}]^2=K^*[\text{VOLED_0}-\text{VDATA}]^2$$

It can be seen that in the stage 'stage4', the driving current I is related only to the voltages VOLED_0 and VDATA, but not the threshold voltage VTH. Besides, when the voltage level VOLED_0 of the OLED 210 increases along with the operation time of the OLED 210, the driving current I can be increased to compensate the luminance reduction of the OLED 210. Therefore, the reduction of frame luminance due to OLED material decay can be avoided and the threshold-voltage shift of the first TFT can be simultaneously compensated in the driving process, thereby maintaining the best image quality under a long using time of the display device.

In the OLED display and pixel driving method thereof disclosed by the above-mentioned embodiment of the invention, no matter how diverse the threshold voltage shift of the first TFT in each pixel is, and no matter what the decay extent of the OLED material in each pixel is, the display can maintain the best image quality for a long using time.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for driving a pixel, the pixel having an organic light emitting diode (OLED), a storage capacitor, and a thin film transistor (TFT), the TFT having a first terminal, a second terminal, and a gate, the first terminal electrically being coupled to one end of the OLED, the other end of the OLED being adapted for receiving a first voltage, the second terminal being adapted for receiving a second voltage, the gate of the TFT being electrically coupled to an end of the storage capacitor, the method comprising:

providing the second voltage to the end of the storage capacitor;

providing a pixel voltage to the other end of the storage capacitor;

discharging the storage capacitor via the TFT and the OLED until conductive current of the OLED is substantially zero and the storage capacitor stores an amount of charges; and generating a pixel current by the TFT for driving the OLED to emit light according to the amount of charges stored in the storage capacitor.

2. The method according to claim 1, wherein:

the pixel comprises a first switch, a second switch and a third switch, the first switch is coupled between the second voltage and the second terminal of the TFT, the second switch is coupled between the second terminal and the gate of the TFT, the third switch is coupled between the pixel voltage and the other end of the storage capacitor, and providing the second voltage and the pixel voltage to the storage capacitor further comprises:

switching on the first switch, the second switch and the third switch such that a terminal voltage at the end of the storage capacitor is the second voltage and a terminal voltage at the other end of the storage capacitor is the pixel voltage.

3. The method according to claim 2, wherein discharging the storage via the TFT and OLED further comprises:

switching off the first switch and switching on the second switch and the third switch such that the storage capacitor is discharged via the TFT and the OLED.

4. The method according to claim 3, further comprising:

switching off the first switch, the second switch and the third switch after the storage capacitor is discharged via the TFT and the OLED.

5. The method according to claim 4, wherein the pixel further comprises a fourth switch coupled between the gate and the first terminal of the TFT, and generating a pixel current by the TFT for driving the OLED to emit light according to the amount of charges of the storage capacitor comprises:

switching on the first switch and the fourth switch and switching off the second switch and the third switch such that the TFT drives the OLED to emit light according to the amount of charges of the storage capacitor.

6. An organic light emitting diode (OLED) pixel circuit, comprising:

a storage capacitor;

an organic light emitting diode (OLED) having a first end and a second end, wherein the second end of the OLED is coupled to a first voltage;

a first thin film transistor (TFT) for driving the OLED to emit light, the first TFT having a gate electrically coupled to one end of the storage capacitor, and a first terminal electrically coupled to the first end of the OLED;

a second TFT having a gate for receiving a first scan signal, a first terminal for receiving a second voltage, and a second terminal electrically coupled to a second terminal of the first TFT;

a third TFT for discharging the storage capacitor via the first TFT and the OLED, the third TFT having a gate for receiving a second scan signal, and a first terminal and a second terminal respectively coupled to the second terminal and the gate of the first TFT;

a fourth TFT having a gate for receiving the second scan signal, a first terminal electrically coupled to the other end of the storage capacitor, and a second terminal for receiving a pixel voltage; and a fifth TFT having a gate for receiving the first scan signal, a first terminal electrically coupled to the first terminal of the first TFT, and a second terminal electrically coupled to the other end of the storage capacitor;

wherein the first voltage is smaller than the second voltage.

7. A display incorporating the pixel circuit according to claim 6.

8. A light emitting diode (OLED) display, comprising:

a driving circuit for outputting a pixel voltage, a first scan signal, and a second scan signal;

a pixel circuit, comprising:

an OLED having a first end and a second end, wherein the second end of the OLED is coupled to a first voltage;

a storage capacitor;

a first TFT for driving the OLED to emit light, the first TFT having a gate electrically coupled to one end of the storage capacitor, and a first terminal electrically coupled to the first end of the OLED;

a second TFT having a gate for receiving the first scan signal, a first terminal for receiving a second voltage, and a second terminal electrically coupled to a second terminal of the first TFT;

a third TFT for discharging the storage capacitor via the first TFT and the OLED, the third TFT having a gate for receiving the second scan signal, and a first terminal and a second terminal coupled to the second terminal and the gate of the first TFT, respectively;

a fourth TFT having a gate for receiving the second scan signal, a first terminal electrically coupled to the other end of the storage capacitor, and a second terminal for receiving the pixel voltage; and a fifth TFT having a gate for receiving the first scan signal, a first terminal electrically coupled to the first terminal of the first TFT, and a second terminal electrically coupled to the other end of the storage capacitor.

9. The OLED display according to claim 8, wherein when driving the pixel circuit, the driving circuit switches on the second TFT, the third TFT, the fourth TFT and the fifth TFT via the first scan signal and the second scan signal such that a terminal voltage at one end of the storage capacitor is the second voltage and a terminal voltage at the other end of the storage capacitor is the pixel voltage, and then the driving circuit switches off the second TFT and the fifth TFT via the first scan signal and the second scan signal and continuously switches on the third TFT and the fourth TFT such that the storage capacitor is discharged via the first TFT and the OLED, and then the driving circuit switches on the second TFT and the fifth TFT and switches off the third TFT and the fourth TFT such that the first TFT generates a pixel current for driving the OLED to emit light according to an amount of charges of the storage capacitor.

* * * * *